US006476717B2

(12) United States Patent
Gross et al.

(10) Patent No.: US 6,476,717 B2
(45) Date of Patent: Nov. 5, 2002

(54) TAMPER-PROOF DISPLAY

(75) Inventors: Paul Herman Gross, Pickering; Simion Stanescu, Toronto, both of (CA)

(73) Assignee: CDA Industries, Inc., Toronto (CA)

( * ) Notice: Subject to any disclaimer, the term of this patent is extended or adjusted under 35 U.S.C. 154(b) by 0 days.

(21) Appl. No.: 09/819,303

(22) Filed: Mar. 28, 2001

(65) Prior Publication Data

US 2002/0011547 A1 Jan. 31, 2002

(30) Foreign Application Priority Data

Apr. 12, 2000 (CA) ..... 2305080

(51) Int. Cl.[7] ..... G08B 13/14

(52) U.S. Cl. ..... 340/568.1; 340/568.2; 340/568.3; 340/568.4; 340/568.8; 340/571; 340/572.8

(58) Field of Search ..... 340/568.1, 568.2, 340/568.3, 568.4, 568.8, 571, 572.1, 572.8, 572.9; 261/DIG. 14

(56) References Cited

U.S. PATENT DOCUMENTS

| | | | | | |
|---|---|---|---|---|---|
| 5,124,685 | A | * | 6/1992 | Rankin | 340/568.1 |
| 5,146,205 | A | * | 9/1992 | Keifer et al. | 340/568.1 |
| 5,341,124 | A | * | 8/1994 | Leyden et al. | 340/568.1 |
| 6,236,435 | B1 | * | 5/2001 | Gertz | 348/373 |

* cited by examiner

*Primary Examiner*—Benjamin C. Lee
*Assistant Examiner*—Toan Pham
(74) *Attorney, Agent, or Firm*—Ohlandt, Greeley Ruggiero & Perle LLP

(57) ABSTRACT

A security display system typically used to display, and permit the handling of, costly items such as cameras, video cameras and recorders, while preventing the theft of those items. The system permits persons to handle the item and prevents theft of the item through a cable which acts to tether the item, provide power to the item and trigger an alarm if it is cut or disconnected. The cable is largely hidden until the item is picked up, as the cable runs through the item support and under the counter.

13 Claims, 6 Drawing Sheets

TAMPER-PROOF DISPLAY

BACKGROUND OF THE INVENTION

1. Field of the Invention

The present invention relates to a security display system typically used as a retail store display, and permits the handling of costly items such as cameras, video cameras and recorders, while preventing the theft of those items. The display can also be used at trade shows, seminars, museums, galleries and the like.

FIELD OF THE INVENTION

2. Description of the Prior Art

Theft of small expensive items on display is always a concern to retailers and many others who wish to display such items to the public. Typical examples of such items are cameras, electronic devices, fragile items, collectors items and scientific instruments.

Security display systems for such items have been developed which permit prospective purchasers to handle the items. Typically, the display item is attached to a mounting device. The mounting device has a cylindrical projection which mates with a round bore in a pedestal. The pedestal is typically attached to a display counter. The mounting device can be withdrawn from the bore in the pedestal, which permits the display item to be handled. When a person is done handling the display item, it can be remounted by inserting the cylindrical projection in the bore.

One such security display system prevents theft by tethering the display item to the display area with an electronic alarm cable, a security cable (or chain) or both. The electronic alarm cable has a switching device at one end which is attached directly to the display item, and a power supply and sensor at the other end. When the power supply and sensor are on, cutting the alarm cable or detaching the switching device from the display item, activates an alarm. To avoid tampering, the power supply and sensor are located where they cannot be accessed by the public. Typically, this is done by installing the power supply and sensor under the display counter and running the alarm cable through a hole in the display counter near the pedestal. If a security cable is also required, one end of the security cable is attached to the mounting device and the other end is attached to a locking security device. The locking security device is installed under the display counter and the security cable typically runs through a hole in the display counter near the pedestal.

Some of the items displayed with this security display system, such as video cameras, require a power supply in order to operate. It is usually preferable to use a remote power supply rather than the batteries supplied with the device, because the batteries may run down when the video camera is being tested by a prospective purchaser and the batteries will wear out if they are cycled repeatedly. Therefore, it is common for a remote reliable power source to be connected to the video camera, or other device, with a power cable.

Typically, with the earlier security display system, the alarm cable, the security cable, the power cable, or all three, project from the side of the display item and run across the display counter to a hole in the display counter. To facilitate handling of the display item it is necessary to have a quantity of each cable available, either on the display counter or stored under the display counter. If the cable is stored under the display counter it must be drawn through the hole in the display counter when the display item is being handled. Prospective purchasers handling the display item have no reason to feed the cable back into the hole when they are done handling the display item and are unlikely to do so. It is possible to include a means whereby the cable is automatically retracted through the hole in the display counter; however, the retraction means would be pulling the display item towards the hole in the display counter and away from the pedestal, making it less likely that the person handling the item would remount it on the pedestal. A retailer might find it necessary to either push the cable back into the hole, or to remount the display item if the cable retracts automatically, after each handling of the display item by prospective purchasers. Further, unless the hole in the display counter is large, which is unsightly, or specially lined, the cable will chafe and suffer damage as it is drawn out of, and pushed into, the hole.

Therefore, the earlier security display system results in unsightly cables prominently visible on the display counter: at the minimum, running directly from the display item to the hole in the display counter, but more likely, strewn upon the display counter. However much cable is on the display counter and whichever way it arrives there, its presence is unsightly and detracts from the desired presentation of the display item.

With this earlier security display system, the mounting device may be inserted in the pedestal in any orientation and it will stay in that orientation until rotated by an outside force. When prospective purchasers are through handling the display item, they may or may not remount the display item by reinserting the cylindrical projection into the bore. However, if they do remount the display item there is no reason for them to orient the display item to its best advantage for the purposes of the person who is displaying it. A retailer might find it necessary to rotate the display item to its desired position after each handling by prospective purchasers.

Therefore, there is a need for a security display system which does not involve unsightly cables cluttering up the display area; which does not require anyone to tidy up the cables after each handling by a prospective purchaser; which does not involve unsightly holes in the display counter; which will guide the prospective purchaser to remount the display item after handling; and which involves minimal chafe to the cable or cables. There is also a need for a display item support which automatically rotates the display item to the preferred position.

SUMMARY OF THE INVENTION

According to one aspect, the invention consists of a releasable display for use with display items such as products for sale, comprising: a pedestal defining a passage through which a cable may run; a product mount defining a channel suitable for containing a cable; a display item attachment on the product mount; and a connection member on the product mount releasably engageable with the pedestal; wherein a cable may be positioned so as to run through the pedestal and the product mount.

The connection member may be rotatably engageable with the pedestal. The passage may be round and the connection member may be cylindrical and fit within the passage.

The releasable display may also have a display item repositioner. The display item repositioner may be: a shoulder positioning surface on the pedestal; and a mount positioning surface on the product mount; wherein said positioning surfaces meet when the connection member is engaged with the pedestal, and said surfaces are configured such that when the connection member is engaged with the pedestal, the product mount will tend to rotate to, and tend to remain in, a particular position relative to the pedestal.

The mount positioning surface may be annular. The mount positioning surface may approximate a section of a plane, said plane being oblique to the axis of rotation defined by the rotation of the product mount relative to the pedestal when the connection member is engaged with the pedestal.

The shoulder positioning surface may be annular. The shoulder positioning surface may approximate a section of a plane, said plane being oblique to the axis of rotation defined by the rotation of the product mount relative to the pedestal when the connection member is engaged with the pedestal.

The releasable display may also have a means for adjusting the position that the product mount will tend to rotate to, and tend to remain in, relative to the pedestal. The position adjusting means may be: a pedestal bottom on the pedestal which rotatably engages the shoulder positioning surface; and a rotation lock for fixing the position of the shoulder positioning surface relative to the pedestal bottom.

The display item attachment may be a bolt with a threaded end engageable in a threaded bore in the display item; and a mounting surface defining a hole through which the threaded end of the bolt may pass. The attachment means may also have a pin projecting from the mounting surface.

According to another aspect the invention consists of a product mount used in association with a pedestal, to display items such as products for sale, comprising: a display item attachment; a means for releasably engaging the pedestal; and a channel through which a cable may run.

According to another aspect the invention consists of a pedestal used in association with a product mount to display items such as products for sale, comprising: a pedestal connector releasably engageable with the product mount; and a passage through which a cable may run.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DETAIL DESCRIPTION OF THE INVENTION

Figure 1:
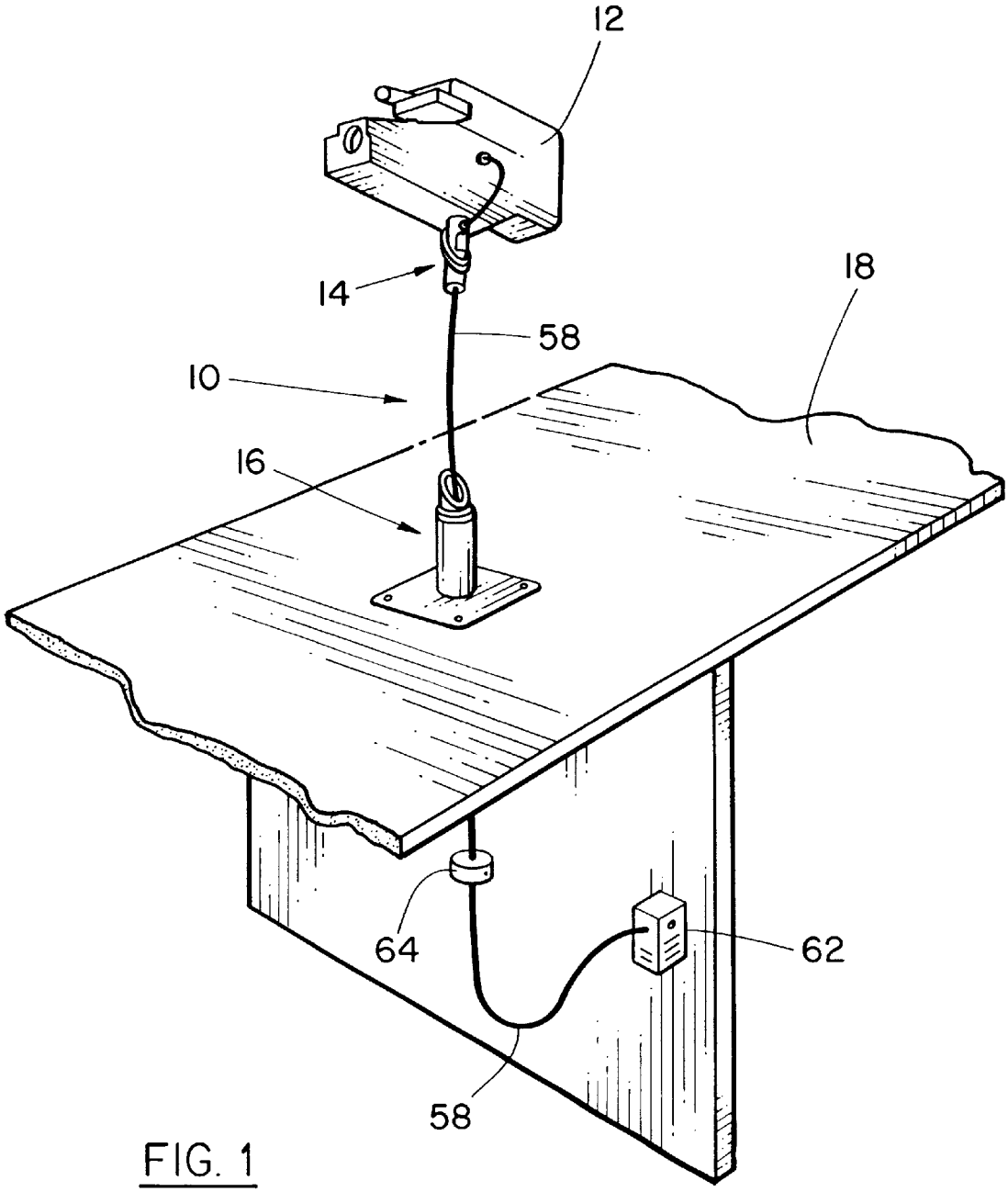
FIG. 1 is a perspective view of a tamper proof display illustrating the present invention in use with a video camera.
Figure 2:
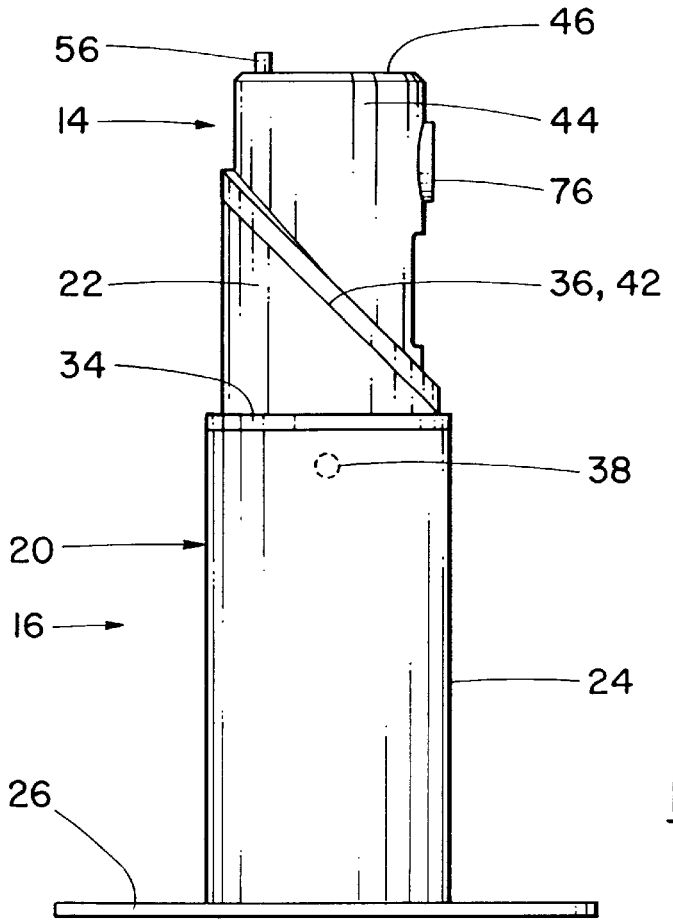
FIG. 2 is a side elevation view of the display.

The security display system 10 illustrating the present invention is shown in FIG. 1. The display item 12 shown in FIG. 1 is a video camera. The display item 12 is attached to the mount 14. The pedestal 16 is attached to the display counter 18.

Figure 3:
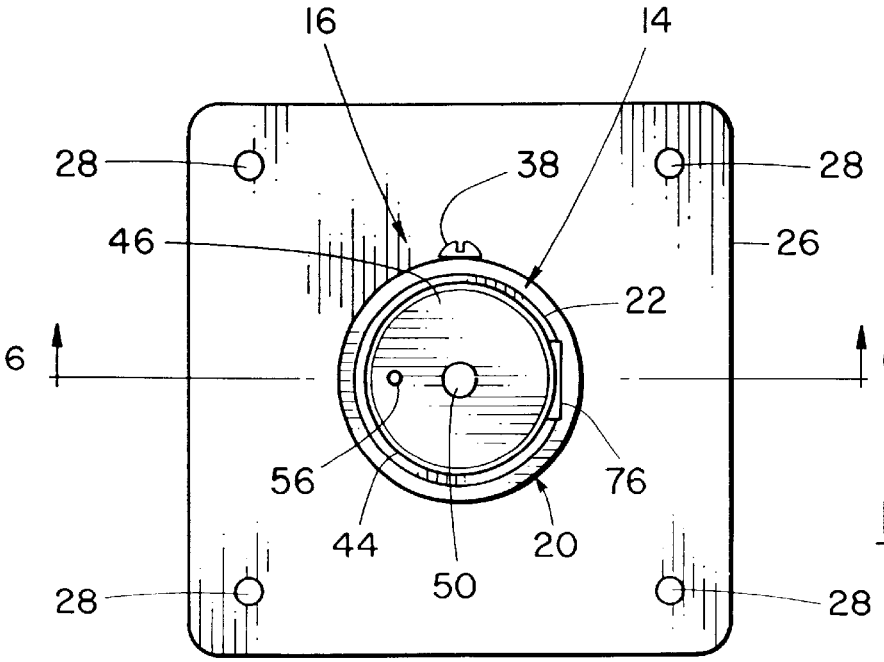
FIG. 3 is a top view of the display.
Figure 6:
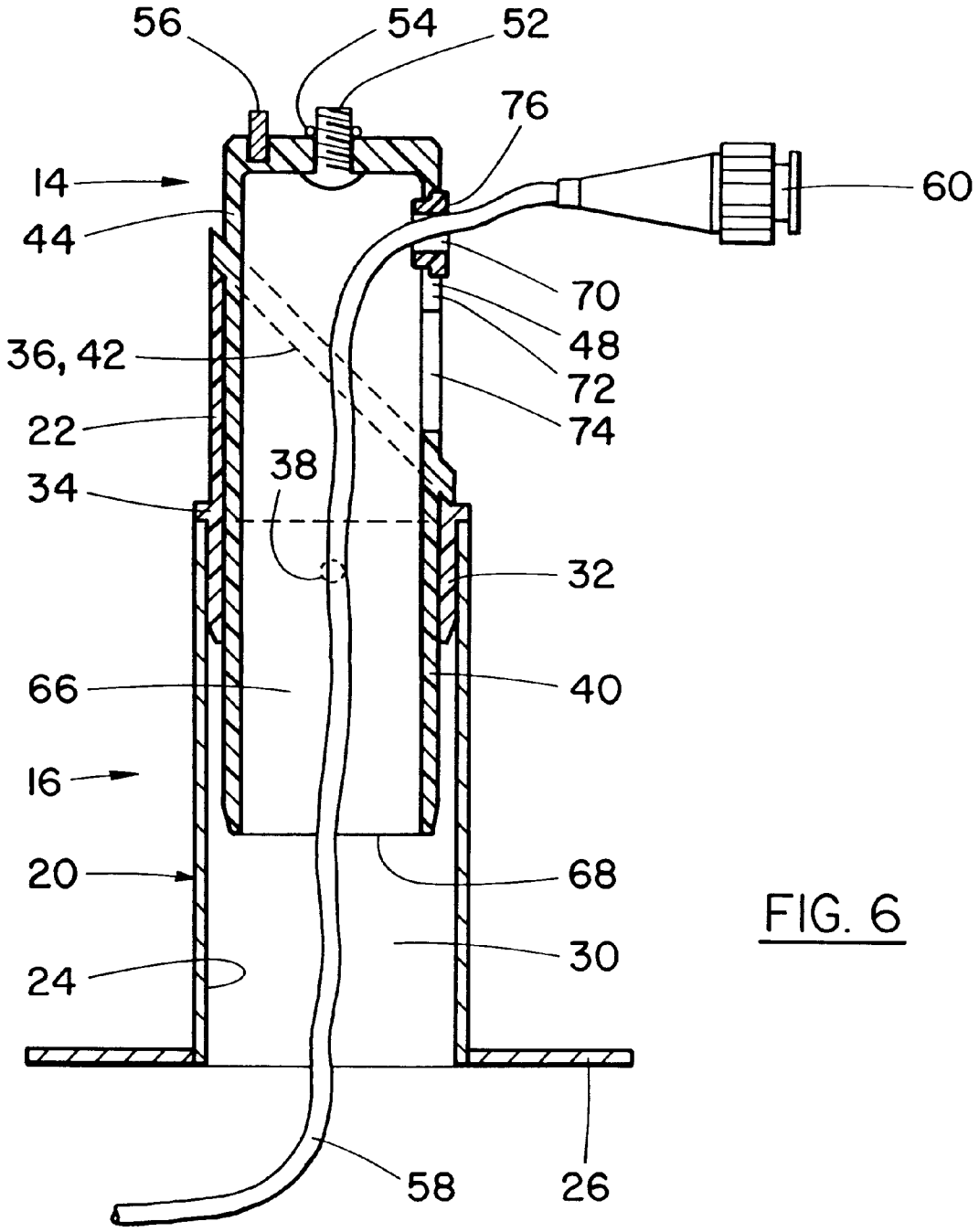
FIG. 6 is a sectional elevation view of the releaseable display showing the routing of the cable.

The pedestal 16 is composed of the pedestal bottom 20 and the shoulder 22. In the illustrative embodiment the pedestal bottom 20 consists of a cylinder 24 attached at one end to, and substantially normal to, a base 26. As shown in FIG. 3, the base 26 has fastener holes 28 so that it can be attached to a display counter 18 with bolts, screws or other appropriate fasteners. As shown in FIG. 6, the pedestal bottom bore 30 runs through the base 26 and runs the length of the cylinder 24.

The shoulder 22 is a cylindrical annulus with a shoulder bore 32, an insertion stop 34 and a shoulder positioning surface 36. The external diameter of the shoulder 22 is sufficiently less than the diameter of the pedestal bottom bore 30 so that the shoulder 22 may be easily inserted into, and rotated within, the pedestal bottom bore 30. In the illustrative embodiment shown in the drawings, the shoulder 22 may be inserted into the pedestal bottom bore 30, until the insertion stop 34 is against the end of the cylinder 24. It will be apparent to those skilled in the art that the cylinder 24 and the shoulder 22 could be configured such that the cylinder 24 could be inserted into the shoulder 22. The shoulder 22 may be rotated within the pedestal bottom bore 30. The orientation of the shoulder 22 relative to the cylinder 24 may be fixed with set screws 38 or other appropriate means. As shown in the Figures, the shoulder positioning surface 36 approximates an annular section of a plane, the plane being oblique to the axis of rotation defined by the rotation of the mount 14 relative to the pedestal 16 when the connection member 40 is engaged with the pedestal 16.

Figure 5:
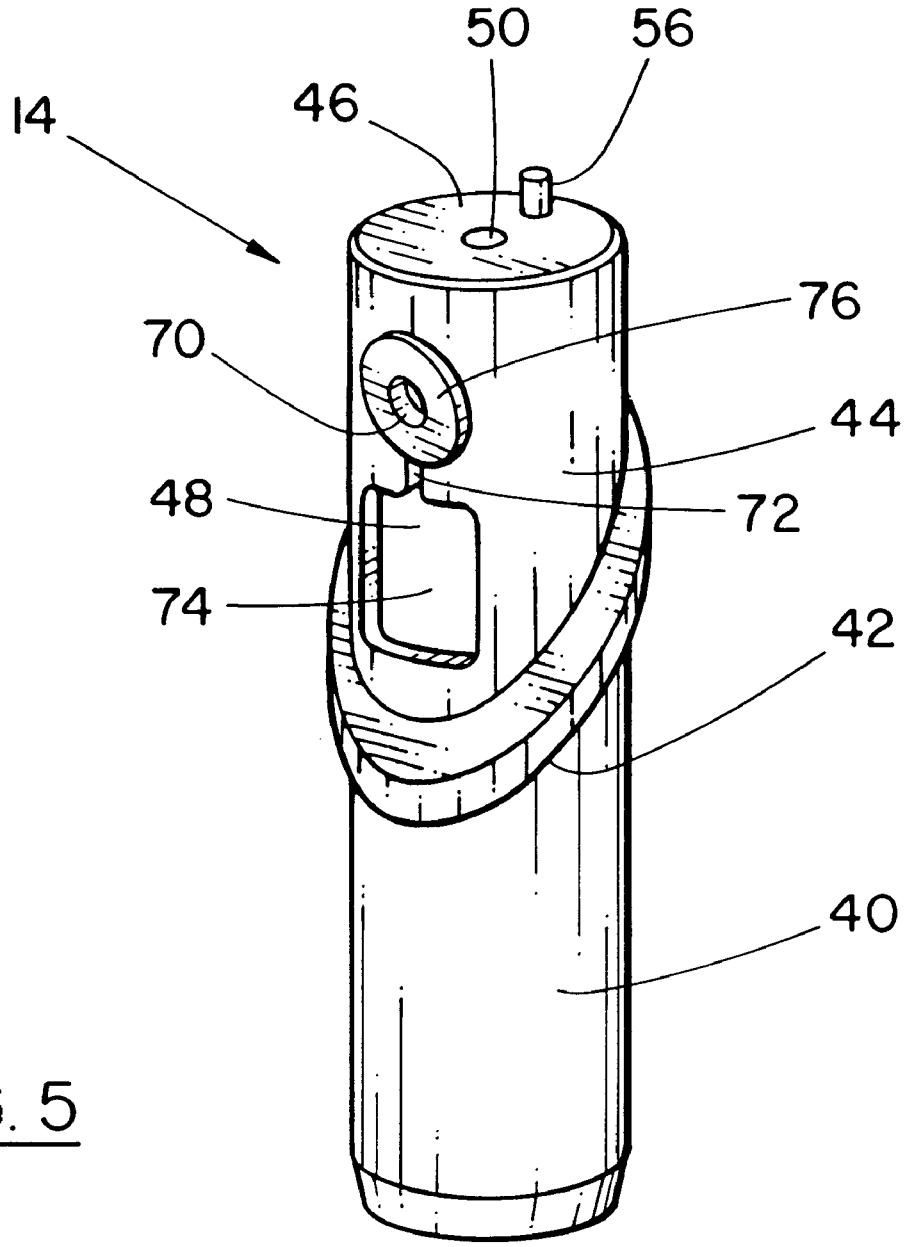
FIG. 5 is a perspective view of the mount showing the cable outlet.

As shown in FIG. 5, the mount 14 is composed of a connection member 40, a mount positioning surface 42 and a projecting member 44. The connection member 40 is cylindrical. The diameter of the connection member 40 is sufficiently less than the diameter of the shoulder bore 32 so that the connection member 40 may be easily inserted into, and rotated within, the shoulder bore 32. The mount positioning surface 42 approximates an annular section of a plane, said plane being oblique to the axis of rotation defined by the rotation of the mount 14 relative to the pedestal 16 when the connection member 40 is engaged with the pedestal 16.

The shoulder positioning surface 36 and the mount positioning surface 42 operate together to automatically orient the shoulder 22 and the mount 14. In a typical display installation, as shown in FIG. 1, the longitudinal axis of the shoulder bore 32 is substantially vertical. The shoulder positioning surface 36 and the mount positioning surface 42 meet when the connection member 40 is fully inserted into the shoulder bore 32. If, when the shoulder positioning surface 36 and the mount positioning surface 42 meet, the plane of which the shoulder positioning surface 36 approximates an annular section and the plane of which the mount positioning surface 42 approximates an annular section, are not substantially coplanar, there will be a space between portions of the shoulder positioning surface 36 and the mount positioning surface 42, and the mount 14 will be sitting higher than it could be if it were rotated. Gravity will cause the mount 14 to rotate until it is in the lowest position possible with respect to the shoulder positioning surface 36 and the mount positioning surface 42. This lowest position is the position where the two planes, the plane of which the shoulder positioning surface 36 approximates an annular section and the plane of which the mount positioning surface 42 approximates an annular section, are substantially coplanar.

It will be clear to those skilled in the art that although the planes, of which the shoulder positioning surface 36 and the mount positioning surface 42 approximate an annular section, are shown in the figures as being similarly oblique to the longitudinal axis of the shoulder bore 32 and the longitudinal axis of the connection member 40, as the case may be, it is not necessary for said planes to be similarly oblique. Further, it will be clear to those skilled in the art, that it is not necessary that the shoulder positioning surface 36 and the mount positioning surface 42 approximate an annular section of a plane. As well, it will be clear to those skilled in the art that it is not necessary for both the shoulder positioning surface 36 and the mount positioning surface 42 to be annular.

The projecting member 44 has a mounting surface 46 and a cable outlet 48. The mounting surface 46 has a bolt hole 50 for insertion of a bolt 52 suitable for screwing into a threaded bore in the display item 12 so as to attach the display item 12 to the mount 14. As shown in FIG. 6, when the bolt 52 is not threaded into the threaded bore in a display item 12, the bolt 52 may be held in position with a bolt retainer 54, a ring of flexible material. The mounting surface 46 also has an alignment pin 56 which interacts with the alignment holes which are typically found on cameras and video cameras for the purpose of mounting them on tripods. The mounting surface 46 may also have additional holes(not shown) into which the alignment pin 56 may be inserted, thereby permitting the orientation of the display item 12, relative to the mount 14, to be changed.

The cable 58 is attached to the display item 12 with the cable plug 60. The cable 58 runs from the display item 12, through the mount 14, through the pedestal (16, through a hole (not visible in FIG. 1) in the display counter 18, to the power supply/alarm 62. The cable 58 conducts power to display items 12 which require it, such as video cameras. The cable 58 also tethers the display item 12 to the display counter 18. The cable 58 may also be coupled with an alarm circuit which triggers an alarm if the cable 58 is cut or disconnected.

In the embodiment shown in FIG. 1, a cable stop 64 is attached to the cable 58 below the display counter 18. The cable stop 64 will not pass through the pedestal bottom bore 30 and therefore only permits a predetermined amount of cable 58 to be pulled up as the display item 12 is being handled. The cable stop 64 acts to ensure that the connection of the cable 58 to the power supply/alarm 62 does not come under tension when the display item 12 is being handled. As well, the cable stop 64 may be weighted sufficiently so as to help retract the cable 58 through the pedestal 16 when the display item 12 is returned to the pedestal 16, but not so heavily that it impedes the handling of the display item 12. The top of the shoulder bore 32, and any other corners on which the cable 58 might rub, may be rounded so that wear on the cable 58 is minimized.

The cable channel 66 runs between the cable port 68 at the end of the connection member 40 to the cable outlet 48 on the side of the projecting member 44. In the embodiment shown in FIG. 6, the cable channel 66 consists of a chamber taking up substantially all of the interior of the mount 14. It will be apparent to those skilled in the art that the cable channel 66 need only be large enough to pass the cable 58 through.

Figure 4:
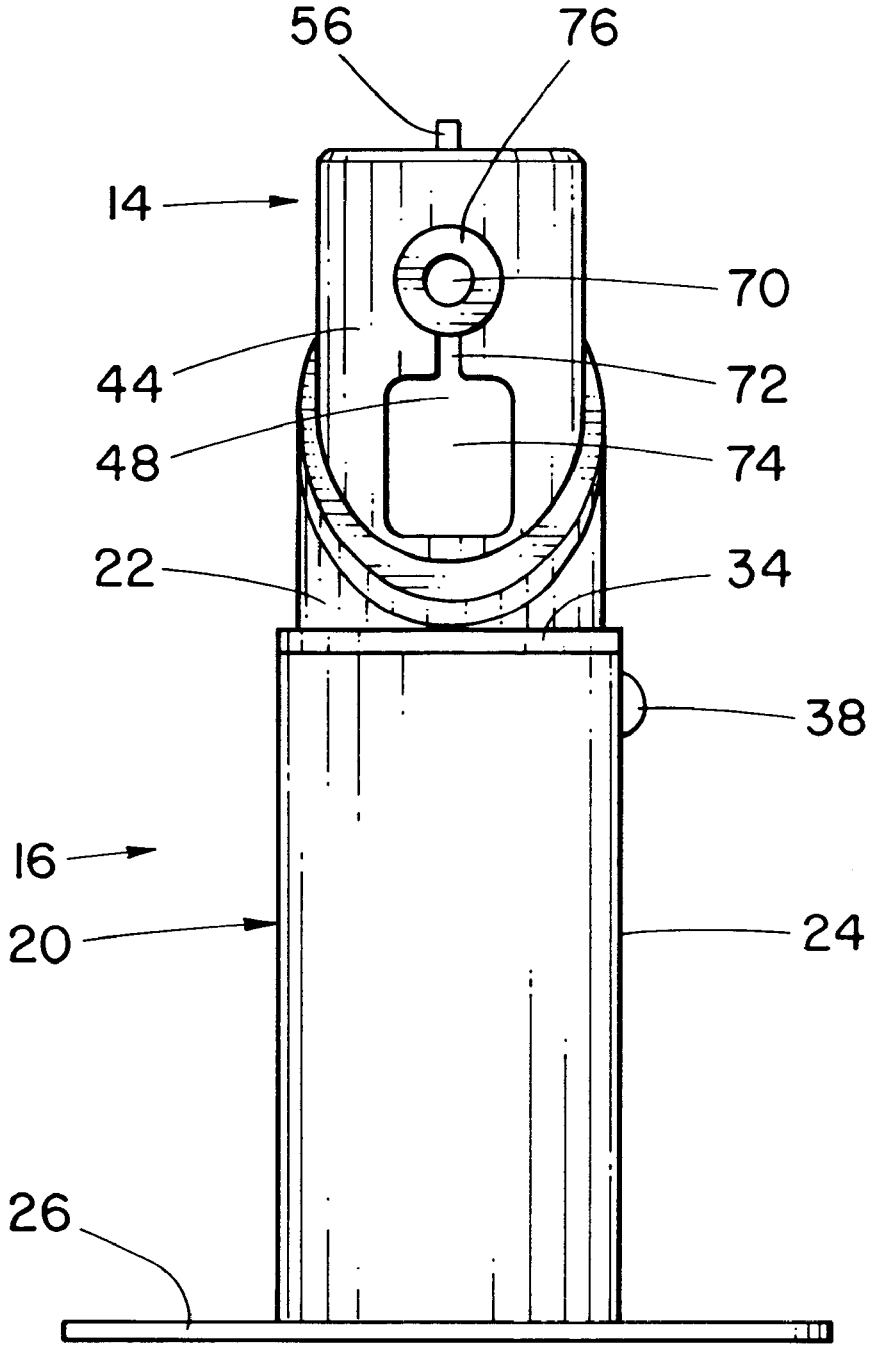
FIG. 4 is an elevation view of the display showing the cable outlet.

In the embodiment shown in FIGS. 4 and 5, the cable outlet 48 consists of a keyhole small end 70, a keyhole slot 72 and a keyhole big end 74. In use the cable plug 60 may be fed into the cable port 68, through the cable channel 66 and out the keyhole big end 74. Typically, the cable plug 60 is too large to fit through the keyhole small end 70 or the keyhole slot 72. Once the cable plug 60 has passed through the keyhole big end 74, the cable 58 may be slid through the keyhole slot 72 into the keyhole small end 70. To protect the cable 58 from chafe and to reduce the strain on the cable plug 60/display item 12 connection when the display item 12 is being handled, a split bushing 76 may be fitted around the cable 58 and positioned in the keyhole small end 70, which is shaped so as to retain the bushing 76.

Figure 7:
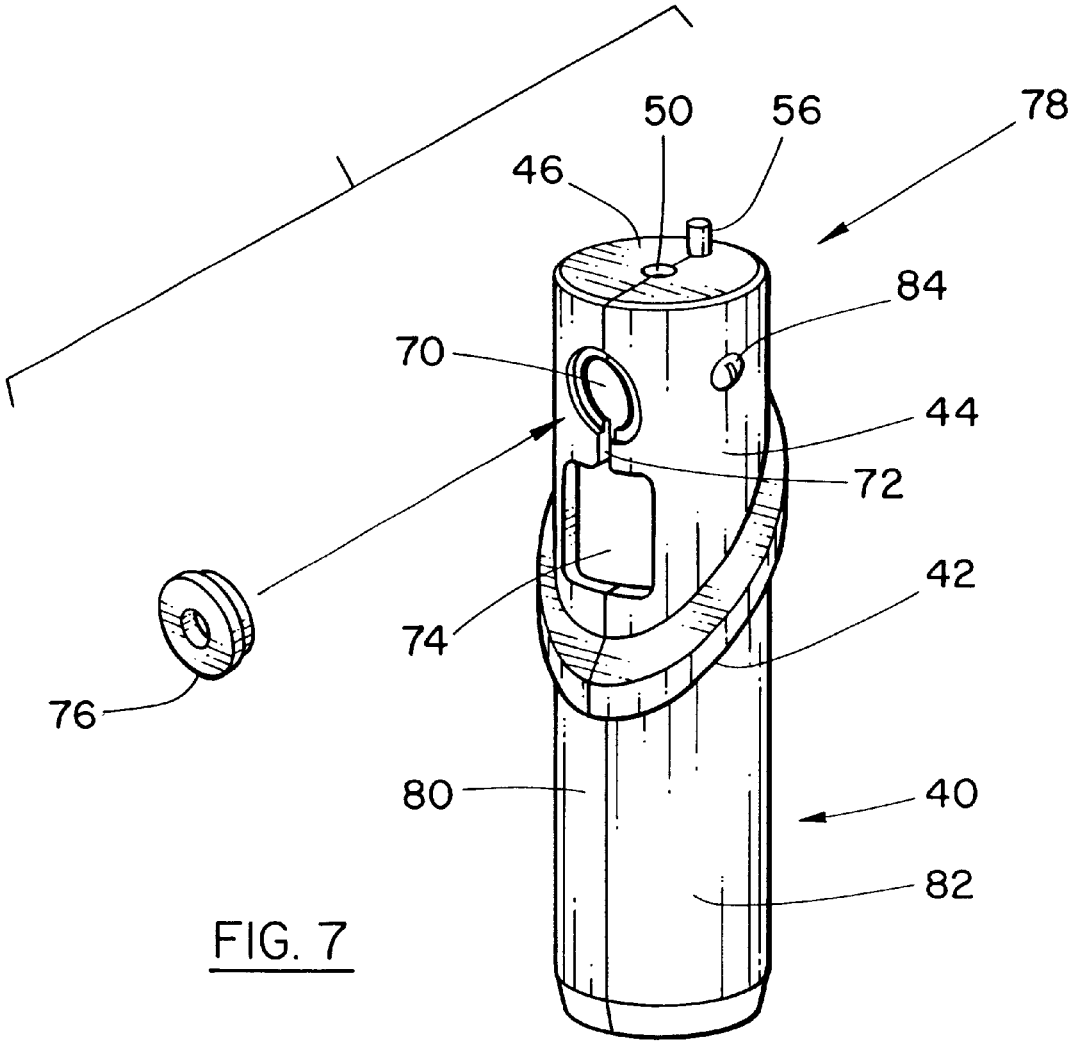
FIG. 7 is a perspective view of an alternative two-part mount.

As shown in FIG. 7, an alternative two-part mount 78 consisting of a left half-mount 80, a right half-mount 82 and a mount assembly screw 84, may also be used. The half-mounts are named "left" and "right" solely to aid in understanding FIG. 7. The left half-mount 80 and the right half-mount 82 are separate bodies which may be attached together by inserting the mount assembly screw 84 into the mount assembly screw hole not shown in the right half-mount 82 and screwing it into an appropriate threaded bore not shown in the left half-mount 80. In use, the cable 58 may be placed in the desired position in the left half-mount 80 prior to attaching the right half-mount 82. This permits the cable outlet 70 to be only so large as is required to accommodate the cable 58, or the bushing 76 if one is required. The bushing 76 may also be prepositioned in the left half-mount 80, with the cable 58 passing through the bushing 76, prior to attaching the right half-mount 82. This permits the bushing 76 and the cable outlet 70 to be configured such that the bushing 76 is more securely fixed than if it is merely pushed into place from one side of the cable outlet 70.

In use, a suitable display spot is chosen on the display counter 18 and a hole is made in the display counter 18. The pedestal bottom 20 is attached to the display counter 18 above this hole, and in such a way that the longitudinal axis of the shoulder bore 32 is substantially vertical when the shoulder 22 is inserted in the pedestal bottom bore 30. The display item 12 is attached to the mounting surface 46 and the cable 58 is run from the power supply/alarm 62 through the hole in the display counter 18, through the pedestal bottom bore 30, through the shoulder bore 32, through the cable channel 66 and out of the cable outlet 48, and the cable plug 60 is attached to the appropriate spot on the display item 12. The shoulder 22 is inserted into the pedestal bottom bore 30. The connection member 40 is inserted into the shoulder bore 32. The mount 14 and the shoulder 22 are rotated, or permitted to rotate, relative to each other until the plane of which the shoulder positioning surface 36 approximates an annular section and the plane of which the mount positioning surface 42 approximates an annular section, are substantially coplanar. Then, without disturbing the positions of the mount 14 and the shoulder 22 relative to each other, the shoulder 22 is rotated in the pedestal bottom bore 30 until the display item 12 is in the desired display orientation. This orientation of the shoulder 22 is then fixed by tightening the set screw 38.

Prospective purchasers approaching the display counter 18 are not confronted with a tangle of unsightly cables on the display counter 18. The display is simple and attractive, consisting of only the display item 12, the mount 14, the pedestal 16 and a short run of cable 58 from the cable outlet 48 to the display item 12. The display item 12 may be picked up and handled by the prospective purchaser. The power conducted by the cable 58 will permit the prospective purchaser to test the operation of the display item 12. When the prospective purchaser is done handling the display item, he or she will be guided to reinsert the connection member 40 into the shoulder bore 32 by the presence of the cable 58 running between them and by the gentle pull exerted by the weight of the cable stop 64 if it is so weighted for this purpose.

If the prospective purchaser remounts the display item 12 after handling it, but does not position the display item 12 in the desired, preset orientation, then the mount 14 and the display item 12 will rotate under the effect of gravity until the display item 12 is in the desired orientation. There will be no need for the party displaying the display item 12 to either reposition the display item 12 or to tidy up the cable 58.

The foregoing is a description of a preferred embodiment of the invention which is given here by way of example. The invention is not to be taken as limited to any of the specific features as described, but comprehends all such variations thereof as come within the scope of the appended claims.

What is claimed is:

1. A releasable display for use with an anti-theft security device, comprising:

a pedestal defining a passage;

a product mount defining a channel suitable for containing a cable;

a display item attachment on the product mount;

a cable adapted to be connected to an alarm disposed through said passage and said channel; and a connection member on the product mount releasably engageable with the pedestal, wherein said cable adapted to be connected to said alarm is positioned to run through the pedestal and the product mount.

2. The releasable display of claim 1, wherein the connection member is rotatably engageable with the pedestal.

3. The releasable display of claim 2, wherein:

the passage is round; and the connection member is cylindrical and fits within the passage.

4. The releasable display of claim 3, further comprising a display item attachment.

5. The releasable display of claim 4, wherein the display item attachment comprises:

a shoulder positioning surface on the pedestal; and a mount positioning surface on the product mount, wherein the mount and shoulder positioning surfaces meet when the connection member is engaged with the pedestal, and wherein the mount and shoulder positioning surfaces are configured such that when the connection member is engaged with the pedestal, the product rotates to a particular position relative to the pedestal.

6. The releasable display of claim 4, wherein the shoulder positioning surface is annular.

7. The releasable display of claim 6, wherein the shoulder positioning surface approximates a section of a plane, said plane being oblique to the axis of rotation defined by the rotation of the product mount relative to the pedestal when the connection member is engaged with the pedestal.

8. The releasable display of claim 2, further comprising a display item attachment.

9. The releasable display of claim 8, wherein the display item attachment comprises:

a shoulder positioning surface on the pedestal; and a mount positioning surface on the product mount, wherein the mount and positioning surfaces meet when the connection member is engaged with the pedestal, and wherein the mount and shoulder positioning surfaces are configured such that when the connection member is engaged with the pedestal, the product mount rotates to a particular position relative to the pedestal.

10. The releasable display of claim 8, further comprising means for adjusting the position that the product mount rotates to and remains in, relative to the pedestal.

11. The releasable display of claim 10, wherein the position adjusting means comprises:

a pedestal bottom on the pedestal which rotatably engages the shoulder positioning surface; and a rotation lock for fixing the position of the shoulder positioning surface relative to the pedestal bottom.

12. The releasable display of claim 1, wherein the display item attachment comprises:

a bolt with a threaded end engageable in a threaded bore in the display item;

and a mounting surface defining a hole through which the threaded end of the bolt may pass.

13. The releasable display of claim 12, wherein the attachment means further comprises a pin projecting from the mounting surface.

* * * * *